US008783459B1

(12) United States Patent
Marcinkowski

(10) Patent No.: US 8,783,459 B1
(45) Date of Patent: Jul. 22, 2014

(54) PRODUCT SUSPENSION PACKAGING

(71) Applicant: The Gillette Company, Boston, MA (US)

(72) Inventor: Stanley Michael Marcinkowski, Peabody, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 13/803,192

(22) Filed: Mar. 14, 2013

(51) Int. Cl.
*B65D 81/02* (2006.01)
*A45C 11/26* (2006.01)

(52) U.S. Cl.
USPC ..... 206/349; 206/476; 206/583

(58) Field of Classification Search
USPC ..... 206/349, 352, 353, 354, 583, 476
See application file for complete search history.

(56) References Cited

U.S. PATENT DOCUMENTS 4,852,743 A 8/1989 Ridgeway
5,218,510 A 6/1993 Bradford
5,388,701 A 2/1995 Ridgeway
5,405,000 A 4/1995 Hagedon et al.
5,762,200 A 6/1998 Goudreau
6,913,147 B2 7/2005 Mueller et al.
7,316,318 B1 * 1/2008 Rosten et al. ..... 206/583
2004/0140243 A1 * 7/2004 Roesel et al. ..... 206/583
2010/0307111 A1 * 12/2010 McDonald et al. ..... 53/396
2011/0240515 A1 10/2011 Ridgeway

* cited by examiner

*Primary Examiner* — Jacob K Ackun
(74) *Attorney, Agent, or Firm* — Kevin C. Johnson; Steven W. Miller

(57) ABSTRACT

The present invention is directed to a package for a solid object. The package includes a first frame and a second frame connected by a hinge. A film material is secured to an inside surface of the first and second frames covering a central opening in each frame. The second frame is folded about the hinge such that the inside surface of the first frame faces the inside surface of the second frame thereby sandwiching a solid object between the film. The solid object has a registration element engaging with a registration portion of an object support member. The first and second peripheral foldable flaps of the first and second frames are shaped and dimensioned to contact the inner surfaces of the walls of an outer container.

8 Claims, 6 Drawing Sheets

PRODUCT SUSPENSION PACKAGING

FIELD OF THE INVENTION

The present invention relates to packaging, more specifically, to suspension packaging of solid objects for retail display.

BACKGROUND OF THE INVENTION

A retail package can be decorative and encourage the purchase of the object or article inside. One purpose of any packaging is to protect the article. Another purpose is to properly display the article to encourage purchase.

A variety of approaches have been used to protect the article within a package. One approach is to use a fill material within an outer container. The fill material may be foam, tissue or other materials. The fill material does a good job of protecting the product during shipping and handling but does not offer a very attractive option for retail display.

Another approach protects the article with deformable wrapping, liners, pads, sacks, or other materials. These materials allow for very limited movement of the article within the container. These materials do a good job of protecting the product during shipping and handling but do not offer an attractive option for retail display.

In another approach, a preformed rigid container or package is used allowing for limited movement of the object within the package. An example of such an approach is a blister pack. These rigid or semi-rigid containers can also be attached to a card to provide a method for rack or hook display. The container may be transparent allowing the customer to view the article inside. The drawback with this approach is that a unique blister needs to be created for each different article of different size or shape to ensure proper protection and display of the article within the package.

There is a need to provide a package for retail display that not only protects the object, but also displays the object in a predetermined position within the package for the encouragement of purchase of the object by a customer.

There is a need to provide a package for retail display that allows for the packaging of a wide variety of solid objects of differing shapes within the same standard package.

SUMMARY OF THE INVENTION

The present invention comprises a package for a solid object. The package comprises a first frame having an inside surface and an outside surface. The first frame has a first central opening therein, an object support member extending from an inside edge of the first frame into the first central opening. The object support member has an object registration portion. The first frame includes a plurality of first peripheral foldable flaps. The package comprises a second frame having an inside surface and an outside surface. The second frame has a second central opening therein. The second frame includes a plurality of second peripheral foldable flaps. The second frame is connected to the first frame by a hinge. A film material is secured to the inside surface of the first and second frames covering the first central opening and the second central opening. The second frame is folded about the hinge such that the inside surface of the first frame faces said inside surface of the second frame thereby sandwiching a solid object between the film secured to the inside surfaces of the first and second frames. The solid object has a registration element engaging with the registration portion of the object support member. An outer container is provided for holding the frames. The outer container has a plurality of walls having inner surfaces. The first and second peripheral foldable flaps are shaped and dimensioned to contact the inner surfaces of the walls of the container.

BRIEF DESCRIPTION OF THE DRAWINGS

The details of one or more embodiments of the invention are set forth in the accompanying drawings and the description below. Other features, objects, and advantages of the invention will be apparent from the description and drawings, and from the claims.

DETAILED DESCRIPTION OF THE INVENTION

Figure 1:
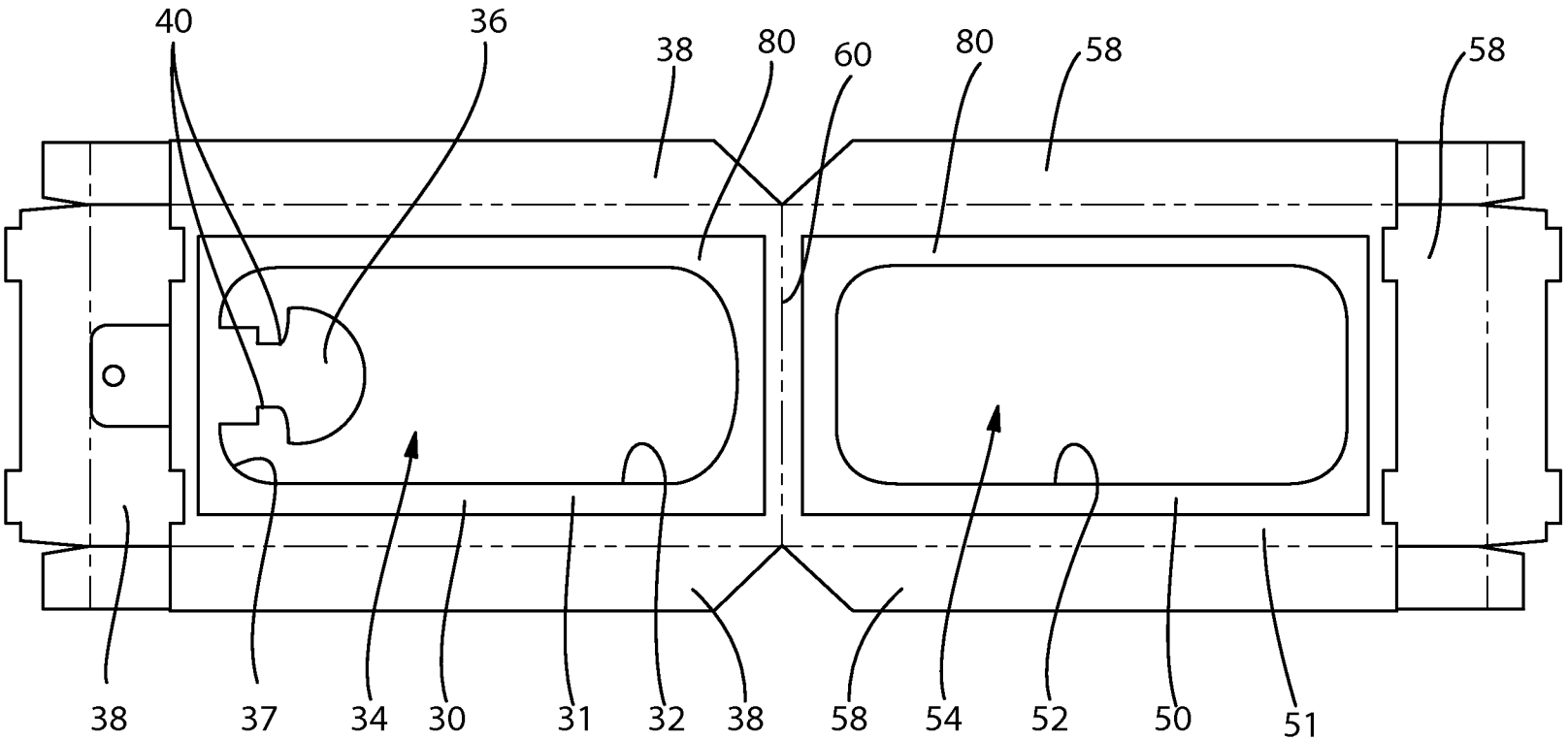
FIG. 1 shows a plan view of the first and second frames.
Figure 2:
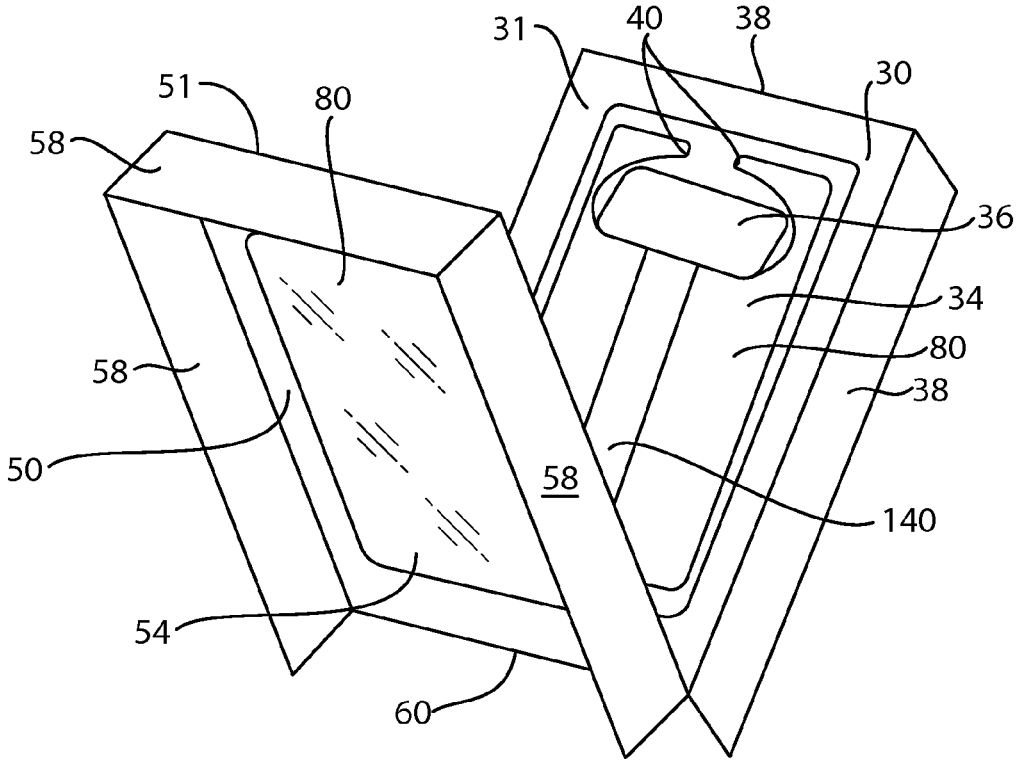
FIG. 2 shows a perspective view of the first and second frames in a partially folded position.

Referring now to FIGS. 1 and 2 there is shown a first frame 30 and a second frame 50 of the present invention. The frames 30 and 50 may be made of paperboard, cardboard or other semi-rigid material such as plastic providing the necessary structural integrity to support and display a solid object. In the embodiment shown, the first frame 30 and the second frame 50 are made of a single piece of material. The frames 30 and 50 may be made of two separate pieces of material. If made of separate pieces of material, the frames 30 and 50 are preferably made of the same material, but may be made of different materials.

The frames 30 and 50 are connected to one another by a hinge 60. If frames 30 and 50 are made of a single piece of material hinge 60 is a fold line or cut line in the material. If the frames 30 and 50 are constructed from separate pieces of material, hinge 60 may be a separate member secured to frames 30 and 50. Alternatively, hinge 60 may be a fold line in either frame 30 or frame 50.

First frame 30 has an inside surface 31 and an outside surface 32. First frame 30 has a first central opening 34. An object support member 36 extends from an inside edge 37 of the first frame 30 into the first central opening 34. The first frame 30 has a plurality of first peripheral foldable flaps 38. The object support member 36 comprises an object registration portion 40.

Second frame 50 has an inside surface 51 and an outside surface 52. First frame 50 has a first central opening 54. The second frame 50 has a plurality of first peripheral foldable flaps 58.

A film material 80 is secured to the inside surface 31 of the first frame 30 and the inside surface 51 of the second frame 51. Film material 80 is secured to inside surfaces 31 and 51 such that it covers the first central opening 34 and the second central opening 54. The film material 80 may be secured to the inside surfaces 31 and 51 with glue or other adhesives. The film material 80 may be secured to the inside surfaces 31 and 51 by other techniques such as heat sealing and the like. The film material 80 is preferably transparent or translucent allowing a solid object to be viewed through film material 80.

Referring now to FIG. 2 the second frame 50 is folded about the hinge 60 such that the inside surface 31 of the first frame 30 faces the inside surface 51 of the second frame 50 thereby sandwiching a solid object 140 between the film 80 which is secured to the inside surfaces 31 and 51 of the first and second frames 30 and 50, respectively. The solid object 140 shown is a razor. However, other solid objects such as toothbrushes, lipstick, brushes, and other solid objects may be used.

Figure 6:
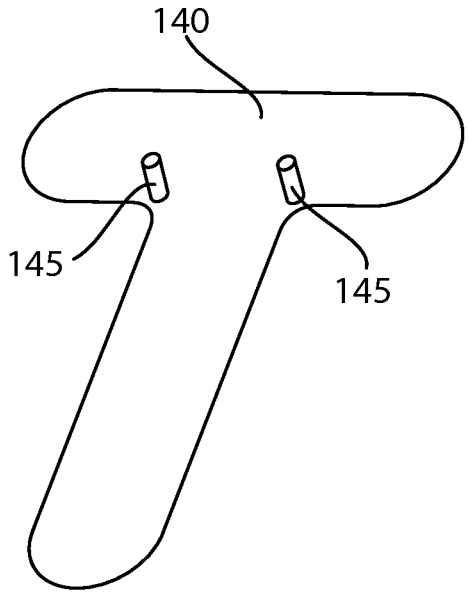
FIG. 6 shows a perspective view of the back portion of the solid object.

Referring now to FIG. 6, there is shown solid object 140. Solid object 140 has a registration element 145 that engages with object registration portion 40 of object support member 36. The registration element 145 shown in the example is a peg(s) extending from the object 140. The engagement of registration element 145 with object registration portion 40 provides for exact placement of solid object 140 within the package. This exact placement is important to allow solid object 140 to be viewed through the openings in the outer container.

Figure 3:
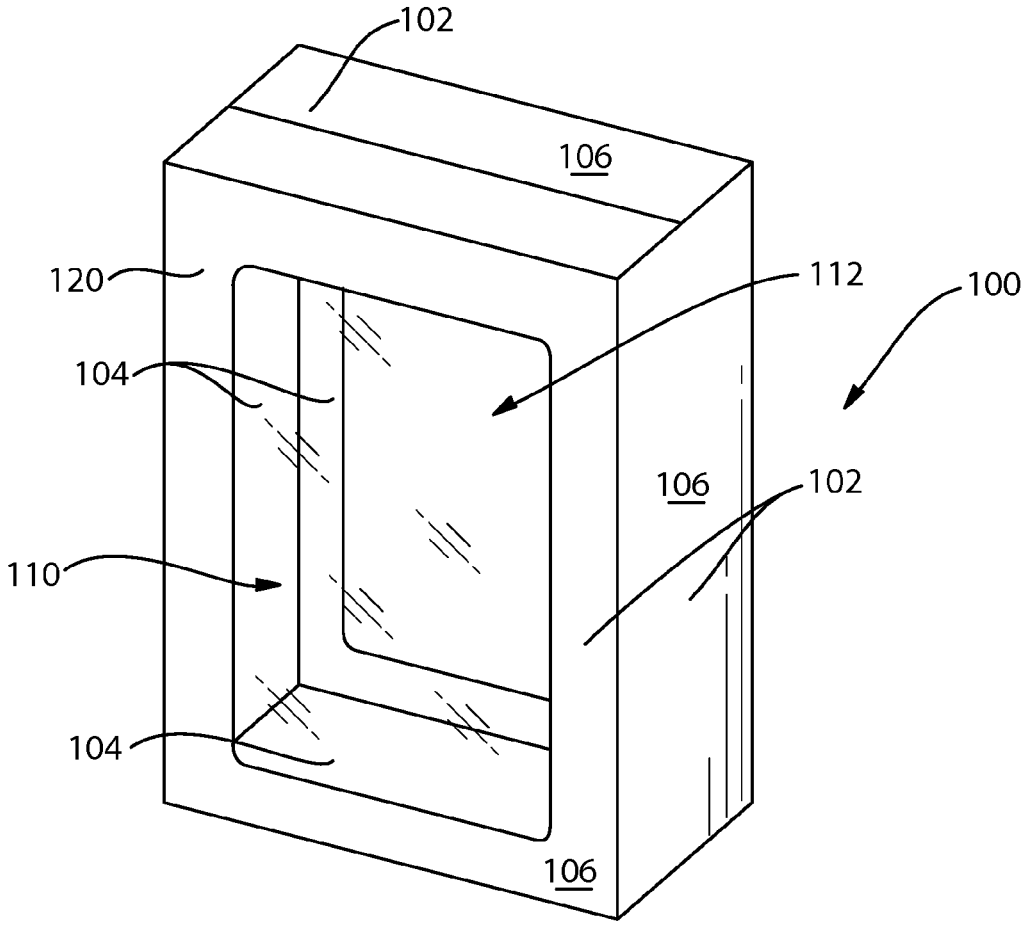
FIG. 3 shows a perspective view of the outer container.
Figure 4:
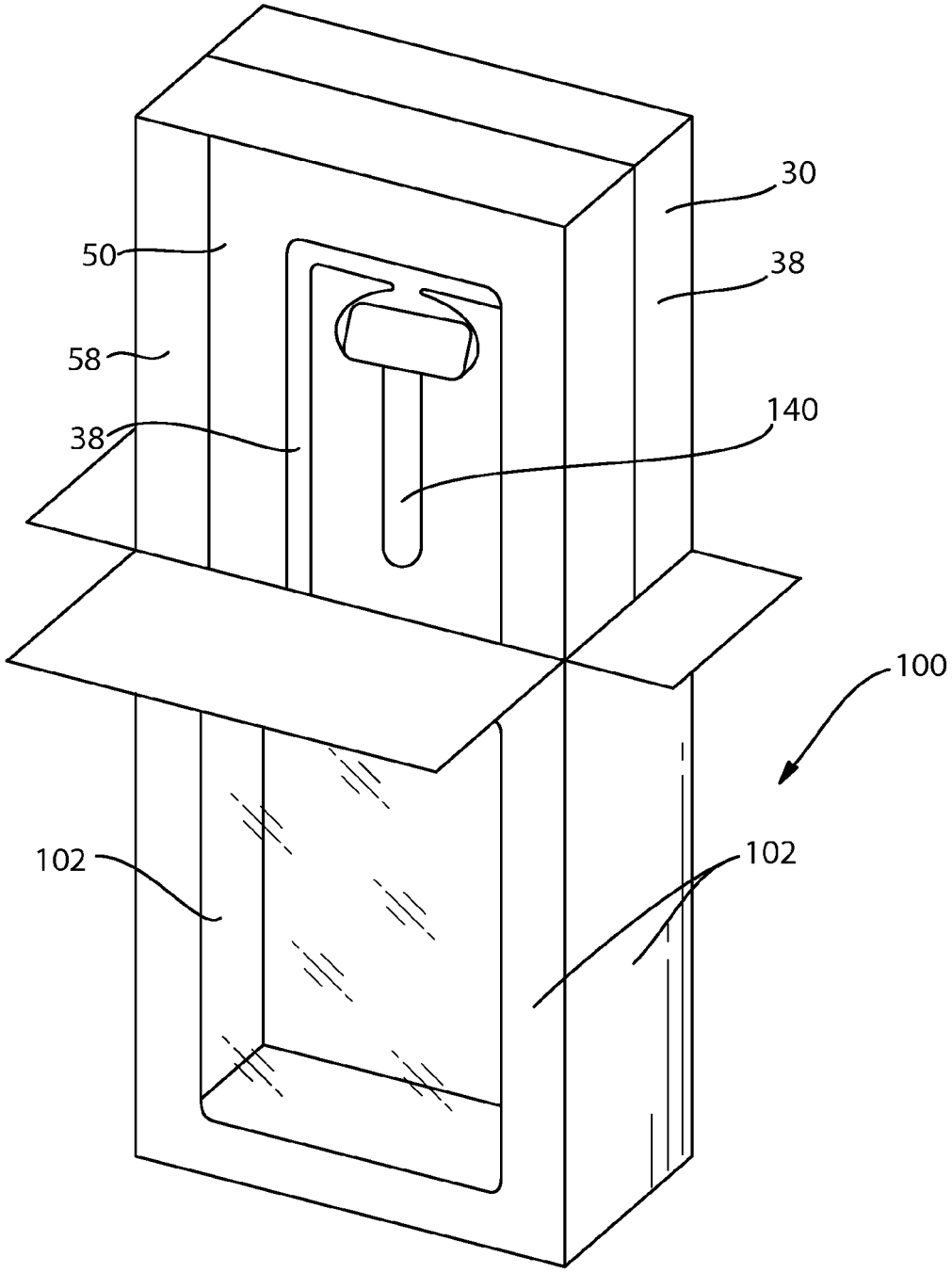
FIG. 4 shows a perspective view of first and second frames partially inserted into outer container.
Figure 5:
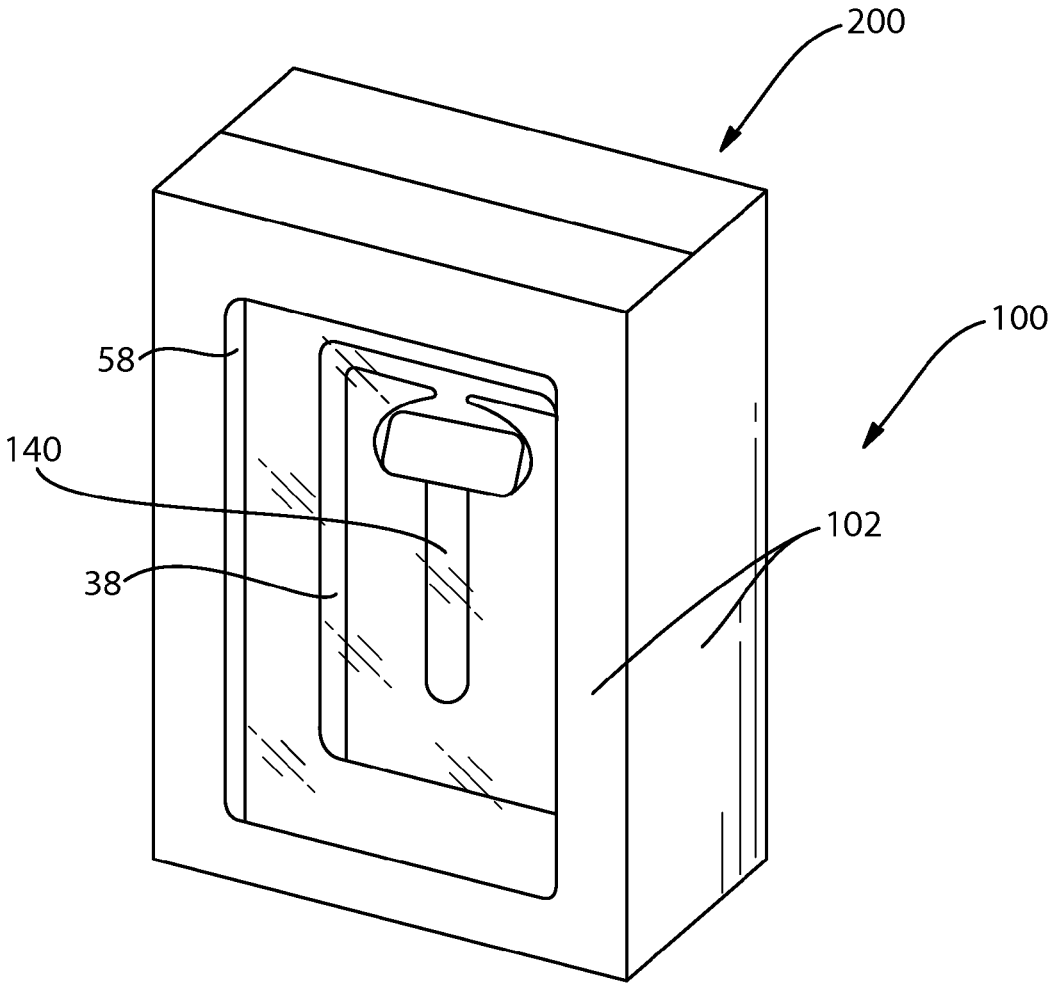
FIG. 5 shows a perspective view of the package of the present invention with first and second frames fully inserted within outer container.

Referring now to FIGS. 3-5 there is shown an outer container 100. The outer container 100 holds frames 30 and 50. The outer container 100 may be made of paperboard, cardboard or other semi-rigid material such as plastic providing the necessary structural integrity to support and display a solid object.

The outer container 100 comprises a plurality of walls 102. Walls 102 have inner surfaces 104 and outer surfaces 106. Walls 102 of container 100 may have an opening therein. In the container 100 shown, the walls 102 have openings 110 and 112. The opening 110 is aligned with opening 112 allowing a user to view completely through container 100.

When the first and second frames 30 and 50 respectively, are inserted into outer container 100, the inner surfaces 104 of container 100 contact the first and second peripheral foldable flaps 38 and 58 respectively, of frames 30 and 50. The foldable flaps 38 and 58 are shaped and dimensioned to contact the inner surfaces 104 of the walls 102 of the container 100.

The opening 110 of the outer container is aligned with said first central opening 34 and the second central opening 54. When the frames 30 and 50 are fully inserted into outer container 100, the alignment of opening 110 with openings 34 and 54 allows for viewing of solid object 140 contained within package 200.

The package 200 of the present invention provides a package for retail display that not only protects the object, but also displays the object in a predetermined position within the package for the encouragement of purchase of the object by a customer. The registration element 145 on object 140 that engages with object registration portion 40 ensures exact placement of object 140 within package 200. The package 200 of the present invention has the versatility to package a wide variety of solid objects of differing shapes within the same standard package. The use of the film 80 to sandwich the solid object within the package 200 allows for a wide variety of sizes and shapes of different objects to be packaged within the package of the present invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package for a solid object comprising:

a. a first frame having an inside surface and an outside surface, said first frame having a first central opening therein, an object support member extending from an inside edge of said first frame into said first central opening, said object support member having an object registration portion, said first frame having a plurality of first peripheral foldable flaps;

b. a second frame having an inside surface and an outside surface, said second frame having a second central opening therein, said second frame having a plurality of second peripheral foldable flaps, said second frame being connected to said first frame by a hinge;

c. a film material secured to the inside surface of said first and second frames covering said first central opening and said second central opening;

d. said second frame being folded about said hinge such that said inside surface of said first frame faces said inside surface of said second frame thereby sandwiching a solid object between said film secured to the inside surfaces of said first and second frames, said solid object having a registration element engaging with said registration portion of said object support member;

e. an outer container for holding said frames, said outer container having a plurality of walls having inner surfaces, said first and second peripheral foldable flaps being shaped and dimensioned to contact said inner surfaces of said walls of said container.

2. The package of claim 1 wherein said film material is transparent.

3. The package of claim 1 wherein said first and second frames comprise paperboard.

4. The package of claim 1 wherein said first and second frames comprise cardboard.

5. The package of claim 1 wherein said outer container comprises paperboard.

6. The package of claim 1 wherein said outer container comprises cardboard.

7. The package of claim 1 wherein said walls of said outer container have an opening therein.

8. The package of claim 7 wherein the opening of said outer container is aligned with said first central opening and said second central opening.

* * * * *